US005094668A

United States Patent [19]

Kern et al.

[11] Patent Number: 5,094,668

[45] Date of Patent: Mar. 10, 1992

[54] ENZYMATIC COAL DESULFURIZATION

[75] Inventors: Ernest E. Kern; William M. Menger, both of Houston, Tex.; David A. Odelson, Mt. Pleasant, Mich.; Anthony S. Sinskey, Cambridge, Mass.; Donald L. Wise, Belmont, Mass.; Debra J. Trantolo, Princeton, Mass.

[73] Assignee: Houston Industries Incorporated, Houston, Tex.

[21] Appl. No.: 441,355

[22] Filed: Nov. 22, 1989

Related U.S. Application Data

[63] Continuation-in-part of Ser. No. 175,557, Mar. 31, 1988, abandoned.

[51] Int. Cl.[5] ..... C10L 9/10; C10L 9/12

[52] U.S. Cl. ..... 44/622; 435/282

[58] Field of Search ..... 44/621, 622, 624, 625; 435/282

[56] References Cited

U.S. PATENT DOCUMENTS

| | | | |
|---|---|---|---|
| 2,641,564 | 6/1953 | Zobell | 435/282 |
| 2,975,103 | 3/1961 | Kirshenbaum | 435/282 |
| 4,206,288 | 6/1980 | Detz et al. | 44/625 |
| 4,256,485 | 3/1981 | Richardson | 44/624 |
| 4,456,688 | 6/1984 | Dugan et al. | 44/624 |
| 4,562,156 | 12/1985 | Isbister et al. | 435/282 |
| 4,632,906 | 12/1986 | Kopacz | 435/282 |
| 4,659,670 | 4/1987 | Stevens, Jr. et al. | 44/625 |
| 4,808,535 | 2/1989 | Isbister | 435/282 |
| 4,851,350 | 7/1989 | Stevens, Jr. et al. | 435/282 |
| 4,861,723 | 8/1989 | Madgavkar | 435/282 |

FOREIGN PATENT DOCUMENTS

| | | | |
|---|---|---|---|
| 10289 | 4/1980 | European Pat. Off. | 44/621 |

*Primary Examiner*—Carl F. Dees

*Attorney, Agent, or Firm*—Pravel, Gambrell, Hewitt, Kimball & Krieger

[57] ABSTRACT

Coal is desulfurized by oxidation to convert organic sulfur moieties in the coal matrix to sulfates, and by treatment with a sulfatase to cleave the sulfates and thereby remove organic sulfur.

18 Claims, 8 Drawing Sheets

FIG.3A
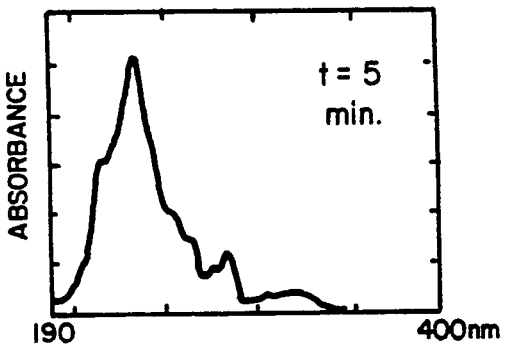
FIG.3B
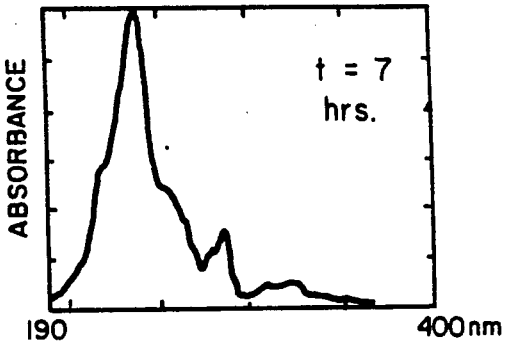
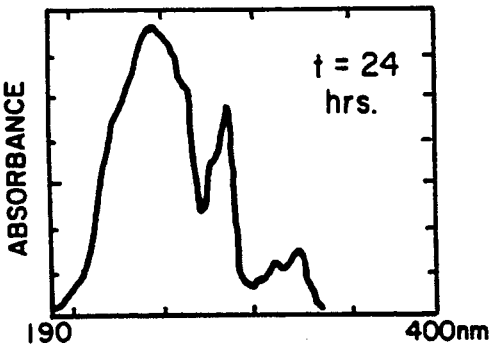
FIG.3C
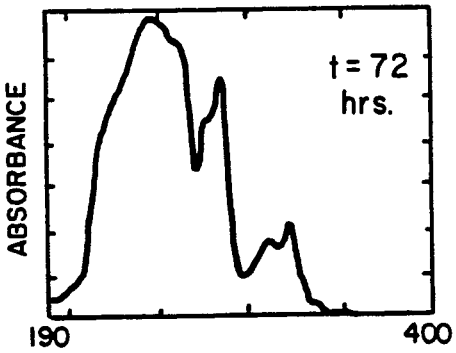
FIG.3D

ENZYMATIC COAL DESULFURIZATION

This is a continuation-in-part of co-pending application Ser. No. 175,557 filed on Mar. 31, 1988 now abandoned.

FIELD OF THE INVENTION

This invention relates to fossil fuel desulfurization, and particularly to the removal of organic as well as inorganic sulfur from coal with enzymes such as oxidases and hydrolases.

BACKGROUND OF THE INVENTION

Due largely to environmental concerns, there is an increasing need for low-sulfur emissions from fossil fuels such as coal which contain sulfur. Heretofore, both post-combustion and pre-combustion desulfurization techniques have been available. For example, flue gas desulfurization is a well know post-combustion process. However, it is generally inconvenient, expensive and limited with respect to the amount and types of sulfur combustion products which can be removed. Flue gas treatment also ignores other economic impacts from the handling and processing of fuels containing sulfur, such as corrosion caused by the sulfur in coal to the equipment used to handle the coal. Pre-combustion processes, on the other hand, which result in low-sulfur fuels, can reduce both sulfur emissions and equipment corrosion.

The bulk of the sulfur content of a fossil fuel exists as inorganic, pyritic sulfur (i.e., a metal sulfide) or as organic sulfur (i.e., sulfur covalently bound to carbon or a hydrocarbon moiety).

Organic and pyritic sulfur each constitute between 20 and 80% of the total sulfur content of coal, depending upon the specific coal variety.

Inorganic pyritic sulfur is generally found in coal in the form of iron pyrite which is disseminated as a separate mineral phase throughout the body of the coal and may be liberated from coal by selected physical or chemical techniques. Conventional coal desulfurization processes to remove inorganic pyritic sulfur include physical methods such as gravity flotation, magnetic, or electrical separation methods. While these physical methods are convenient and economical, they are capable of removing only inorganic (pyritic) sulfur and generally result in notable energy losses from the coal.

Chemical desulfurization methods known for the treatment of coal convert inorganic pyritic sulfur to a water-soluable sulfate form to enable the removal of the inorganic sulfur compound by water extraction. (Wilson, European Patent Application 0 010 289). While chemical coal desulfurization processes, such as oxidation with ferric salts, chlorine or ozone, or reduction with a solvent-hydrogen mixture or alkali, may be effective in removing some types of organic sulfur, many types of organic sulfur are not susceptible to attach by chemical reagents. In addition, these methods generally have numerous disadvantages, such as, corrosion problems from reagents, high energy requirements, and costly reagent recovery and loss of desirable qualities of the coal.

Richardson (U.S. Pat. No. 4,256,485) suggests that coal may be treated with oxidative enzymes produced in situ by the fermentation of yeast. The oxidative enzymes produced by this live yeast system convert inorganic pyritic sulfur to inorganic sulfate for removal by water extraction. As with chemical oxidation methods, enzymatic oxidation by live yeast cells may also enable the water extraction of some types of organic sulfur compounds.

Attempts have also been made to remove inorganic and organic sulfur from coal by microbiological methods. Early interest in this field focused on microorganisms which were naturally suited for pyritic sulfur digestion, such as Thiobacillus found in mine waters and Sulfolobus found in sulfur springs, as reported in Detz et al, *American Mining Congress Journal,* vol. 65, p. 75 (1979); Kargi et al, *Biotechnology and Bioengineering,* vol. 24, pp. 2115-2121 (1982). Such bacteria are effectire in removing only inorganic pyritic sulfur and have no propensity for organic sulfur removal.

Although such processes as Wilson European Patent Application 0 010 289 and Richardson, U.S. Pat. No. 4,256,485 reduce the total sulfur content of a fossil fuel, the reduction generally corresponds only to the amount of inorganic pyritic sulfur present in the fossil fuel. Such processes are not effective for substantially reducing the organic sulfur content of the fossil fuels. Consequently, the treated fossil fuel often retains an objectionable high sulfur content.

Theoretically, organic sulfur cannot be removed from coal unless the chemical bonds holding the sulfur are broken or the organic sulfur compound is extracted (*Encyclopedia of Chemical Technology,* Vol. 6, John Wiley & Sons, pp. 306-324, 1979). Because organic sulfur is an integral part of the chemical structure of the coal, it has not been possible to remove organic sulfur from coal without severely disrupting the chemical bonding which occurs within the structure of the coal. Those processes which have been successful in removing organic sulfur from coal require extreme process conditions, e.g. pressure and temperature, are expensive, and require the input of large quantities of energy.

More recently, efforts have focused on the adaptation of microorganisms for organic sulfur removal. Such attempts are reported, for example, in Isbister et al, "Microbial Desulfurization of Coal", in Attia (ed), *Processing and Utilization of High Sulfur Coal,* p. 627 (1985); and Robinson and Finnerty, "Microbial Desulfurization of Fossil Fuels" (University of Georgia) and Stevens, U.S. Pat. No. 4,659,670. There are, however, numerous obstacles which must be overcome before such microbial techniques become practical. For example, optimal growth conditions in a large scale process are difficult and expensive to maintain, typically requiring expensive growth factors and excessive nutrients or additives. Such additives themselves can be a potential environmental concern and possibly as difficult to remove economically as the sulfur. The growth of the microorganisms can also produce toxic by-products or compounds which may result in mortality or render the microorganisms incapable of catabolizing sulfur. In addition, such fermentation processes are usually plagued with problems such as culture stability, mutation or contamination, reactor upsets, substrate variation, and the like.

There remains an unfilled need for an economical and efficient method for desulfurizing coal and other fossil fuels which method significantly removes both organic and inorganic types of sulfur.

SUMMARY OF THE INVENTION

The present invention involves the biochemical treatment of coal and other fossil fuels to remove both organic and inorganic sulfur from the fossil fuel. The biochemical treatment comprises contacting the organic sulfur-containing fossil fuel with an enzyme or enzymes in an amount generally effective to reduce the amount of organic and inorganic sulfur in the fuel. The enzymes are added directly to the fossil fuel and need not be produced by microorganisms growing on the fossil fuel as a substrate or growth medium. Thus, the process need not be controlled to maintain the viability of any enzyme-producing microorganisms, but can be optimized to favor enzymatically mediated conversion of the sulfur into a form that can be separated from the fossil fuel.

In a broad aspect, the present invention provides a method for removing both organic and inorganic sulfur from a fossil fuel. The process comprises optionally oxidizing both inorganic and organic sulfur in a fossil fuel, and thereafter contacting the oxidized fossil fuel with a sulfatase and recovering the fossil fuel with a reduced organic and inorganic sulfur content.

BRIEF DESCRIPTION OF THE DRAWINGS

FIG. 3 is a graphical illustration of spectral data of filtrates of dibenzothiophene (DBT) treated with a peroxidase and a sulfatase as described in Example 1 hereinbelow. FIGS. 3 A,B,C, and D show data obtained at 5 minutes, 7 minutes, 24 hours, and 72 hours of treatment, respectively;

DESCRIPTION OF PREFERRED EMBODIMENTS

Figure 2:
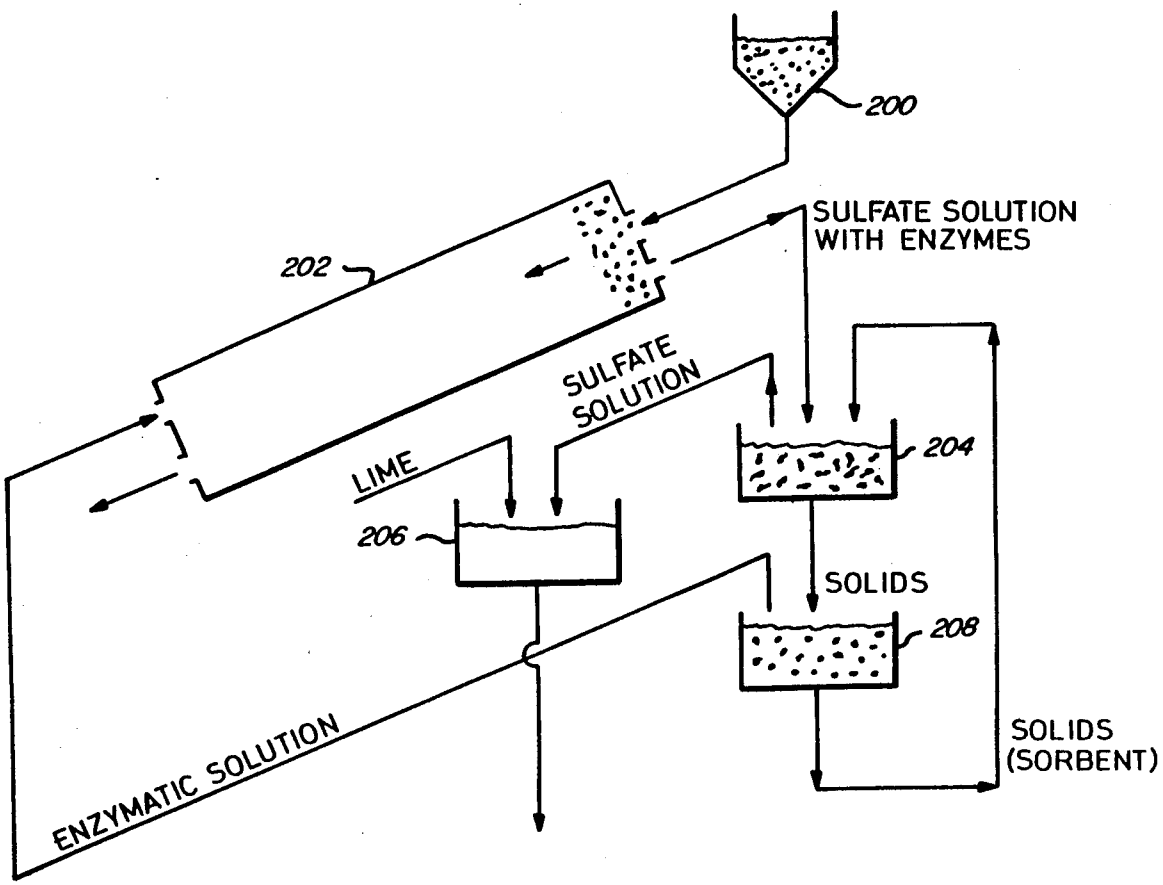
FIG. 2 is a schematic illustration of an alternate embodiment of the process according to the present invention.

The present invention includes a process for treating fossil fuels, and especially fossil fuels containing organic sulfur. Contemplated fossil fuels include petroleum and coal; products of fossil fuel conversion processes, e.g., coal-derived liquids, are also considered. As used herein, coal includes any coalified organic material such as peat, lignite, sub-bituminous coal, bituminous coal and anthracitic coal. The fossil fuel should contain organic sulfur to obtain the most benefit from treatment according to the present invention, although inorganic sulfur could also be removed by this process. By organic sulfur is generally meant organic thiophenes, sulfides and thiols, whereas inorganic sulfur generally refers to metallic sulfides such as pyrite.

Many sulfatase enzymes prefer organic sulfur oxide as a substrate. Therefore, according to the present process, a two-step reaction pathway is generally employed. Initially, the organic sulfur is converted into an organic sulfur oxide, e.g., organic sulfate, by oxidation. However, in some rare instances oxidation may not be necessary, because the organic sulfur may be predominantly in the organic sulfate form or substantially only the naturally occurring organic sulfate is to be removed. In this sense, the oxidation can be considered to be an optional reaction. However, for optimal total sulfur removal, oxidation is preferred. The oxidation substantially converts the organic sulfur into organic sulfate. The organic sulfate is enzymatically removed, for example, by hydrolysis induced by a sulfur hydrolase, e.g., a sulfatase.

It is also contemplated that other sulfatases having alternative organic sulfur substrate preferences may be utilized without prior oxidation.

Sulfatase enzymes catalize the hydrolysis of sulfate esters. In the presence of a sulfatase, sulfur is effectively isolated from organic sulfur compounds and may be retrieved as water-soluble free sulfate.

The fossil fuel may be prepared for treatment according to the present method by generally known methods; e.g., solid fossil fuels, such as coal, can be ground and slurried in water. The slurry can be prepared by grinding the solid fossil fuel to an appropriate particle size, typically 10–50 μm, and mixing it with water. For the purpose of illustration only, the invention is described hereinbelow with reference to a ground coal slurry with the understanding that other fossil fuels and media may be analogously employed. For example, in the case of oil, it may be sufficient to prepare an emulsion if an aqueous enzymatic treatment is employed, or to treat the oil neat, with a solvent, or in mixture with another immiscible fluid.

The oxidation of the coal slurry may be effected by treatment with an oxidation enzyme, such as, a peroxidase, a laccase, or a like oxidase. As used herein, a peroxidase is any enzyme having the E.C. number 1.11.1.7, e.g., horseradish peroxidase, and a laccase is any enzyme having E.C. number 1.10.3.2, e.g., *Pyricularis oxyzae* laccase.

Alternatively, partial oxidation may be effected by mild alkaline or acidic treatment of the coal particles. For the former case, generally the coal is contacted with 5–10 parts by weight of caustic per 100 parts by weight coal. The contact is for a brief period at an elevated temperature of 125°–200° C., preferably 150°–180° C. The exposure to the elevated temperature is preferably effected by rapid heating to the treatment temperature, e.g., in less than about three minutes, preferably in less than about one minute, and most preferably in about thirty seconds. The duration of the coal alkali contact at the treatment temperature is preferably about 1–10 minutes and most preferably about 3–5 minutes. Following the exposure to the elevated temperature, the coal/alkali mixture is rapidly cooled or quenched to below 100° C., preferably in less than about three minutes, and most preferably in less than about one minute, i.e., about 30 seconds.

It should also be understood, however, that acidic oxidation at ambient temperature may be performed instead of alkaline treatment. This would be done in the conventional oxidative manner of pretreatment of coal prior to desulfurization as an alternative chemical oxidation technique.

The oxidation serves to convert the organic sulfur moieties into organic sulfur oxide or moieties, such as organic sulfate. It is desirable to convert the maximum possible amount of organic sulfur to sulfur oxides. On the other hand, full oxidation to organic sulfur dioxide is generally undesirable, as also is excessive oxidation of the carbon in the coal matrix. Usually the desired degree of oxidation can be achieved by varying the type of alkali, oxidase or other oxidant, the oxidant concentration, the duration of contact between the coal and the oxidant, and other conditions of treatment, e.g., pH, temperature, oxygen availability.

The hydrolysis of the oxidized organic sulfur moieties is then effected, as mentioned above, by sulfatase treatment. As used herein, sulfatase includes any enzyme capable of hydrolyzing the organic sulfur moieties to yield a water-soluble sulfur compound. Specific examples include enzymes having the E.C. number 3.1.6.1, such as limpet sulfatase, *Aerobacter aerogenes* sulfatase, abalone entrail sulfatase, *Helix pomatia* sulfatase, and the like.

Figure 1:
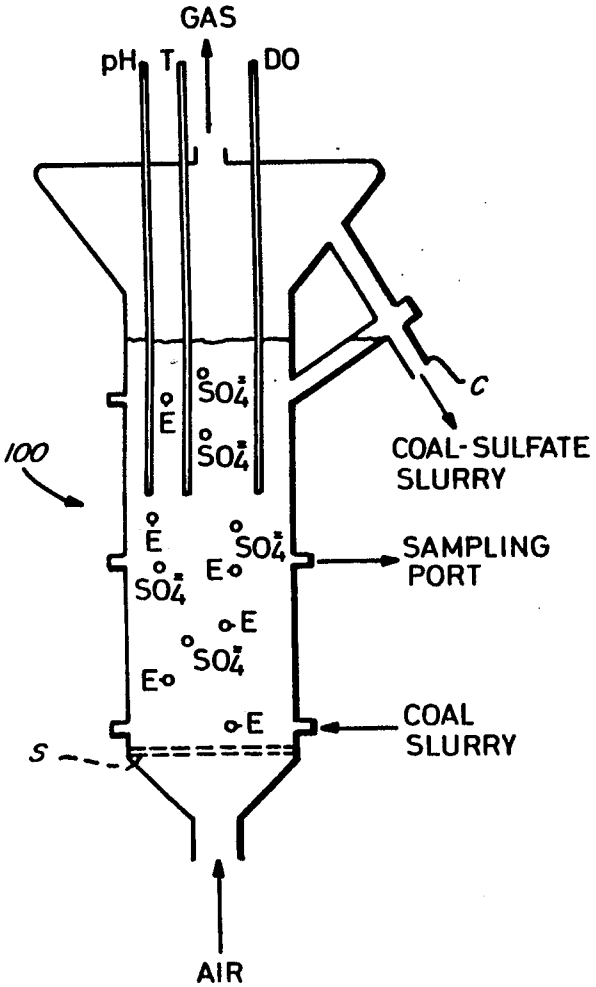
FIG. 1 is a schematic illustration of an embodiment of the process according to the present invention.
Figure 4A:
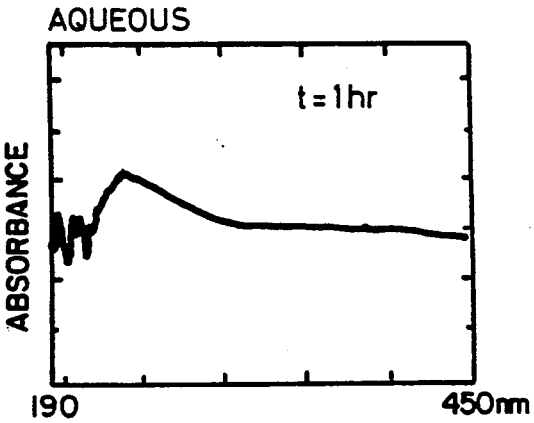
FIG. 4 is a graphical illustration of spectral data of filtrates of Wyodak coal at various periods of time following treatment with a peroxidase and a sulfatase, as described in Example 2 hereinbelow. Each pair of figures shows data obtained from aqueous treated filtrates and that of the control for each time period as follows: A and B, 1 hour; C and D, 2 hours; E and F, 4 hours; G and H, 8 hours; I and J, 16 hours; K and L, 24 hours; M and N, 1 day; O and P, 2 days; Q and R, 3 days; S and T, 4 days; and U and V, 5 days.
Figure 4B:
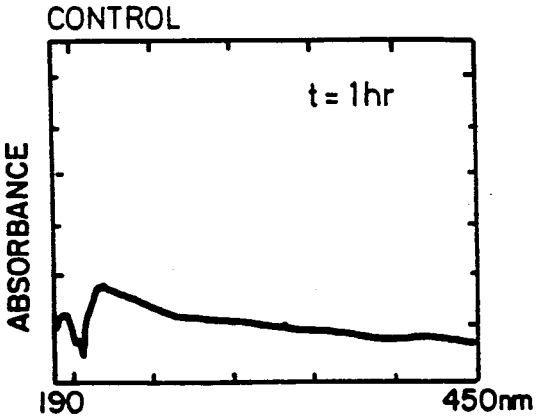
Figure 4C:
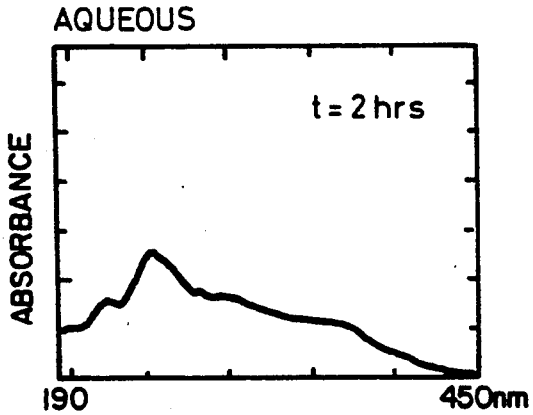
Figure 4D:
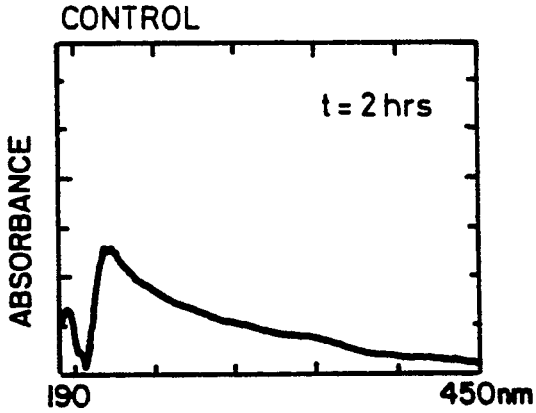
Figure 4E:
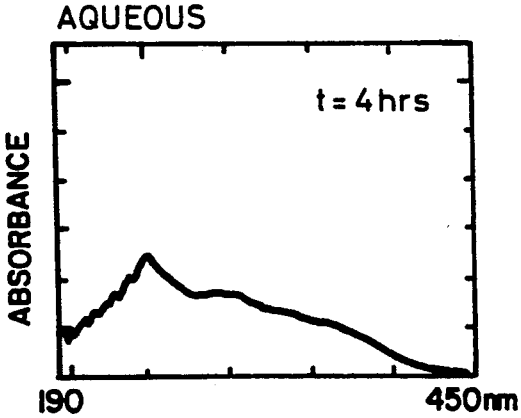
Figure 4F:
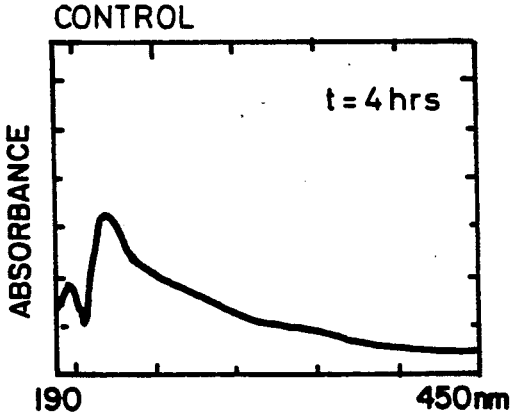
Figure 4G:
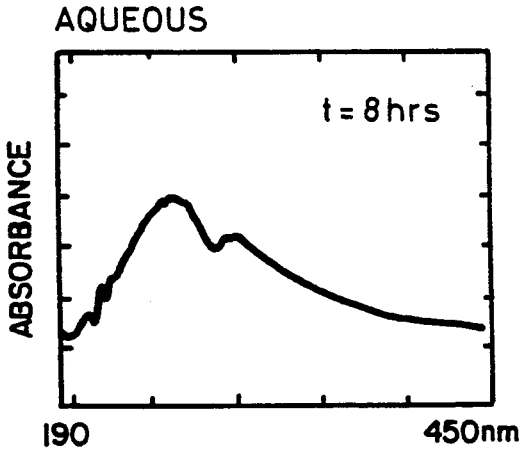
Figure 4H:
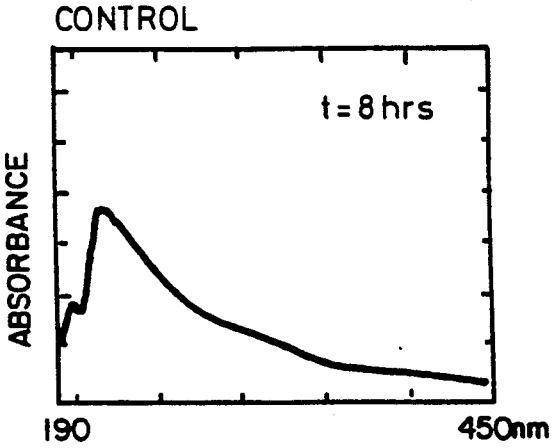
Figure 4I:
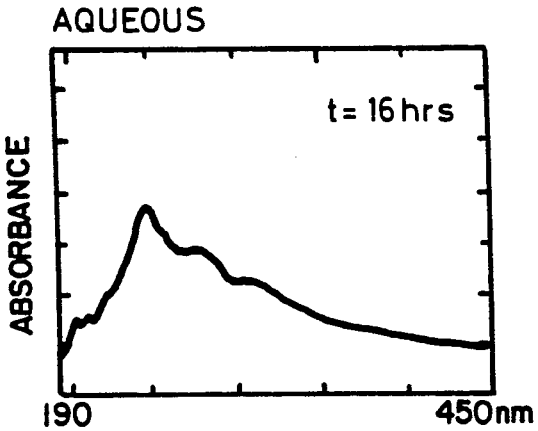
Figure 4J:
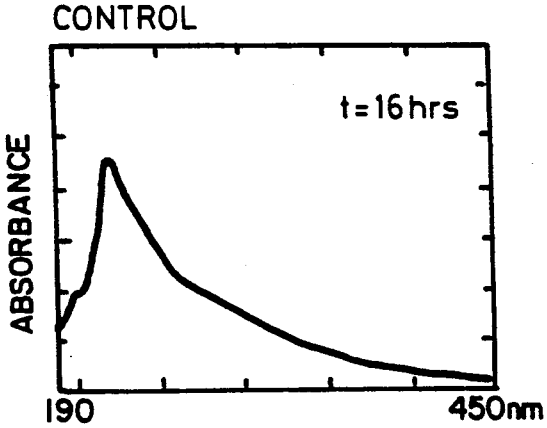
Figure 4K:
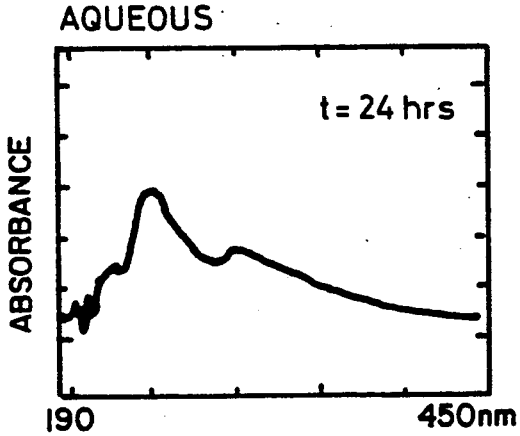
Figure 4L:
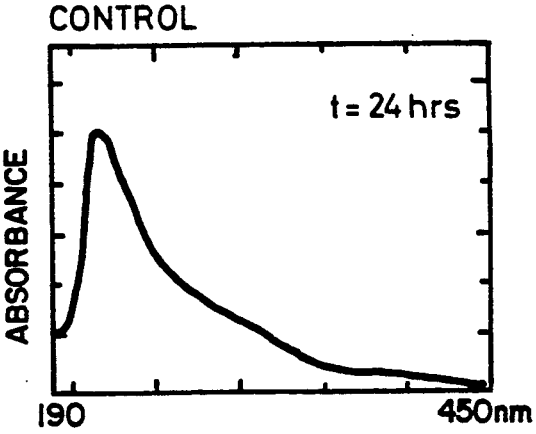
Figure 4M:
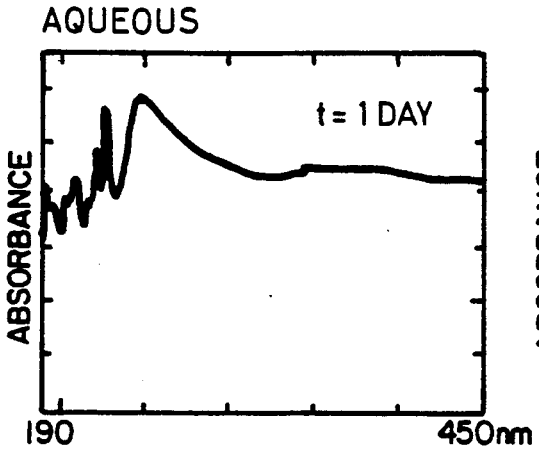
Figure 4N:
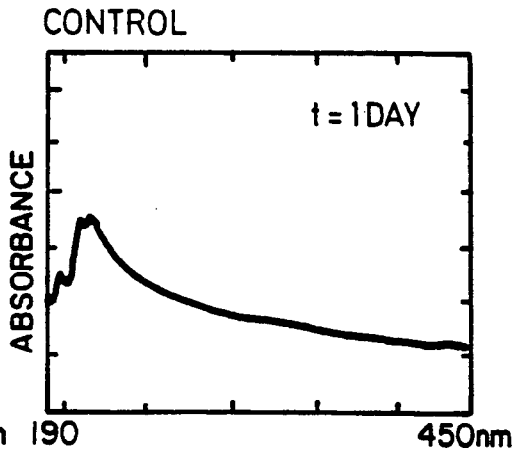
Figure 4O:
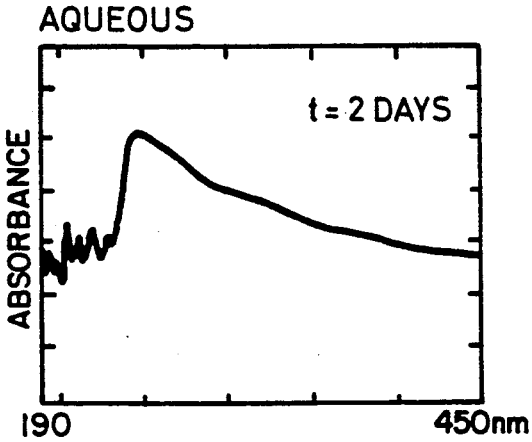
Figure 4P:
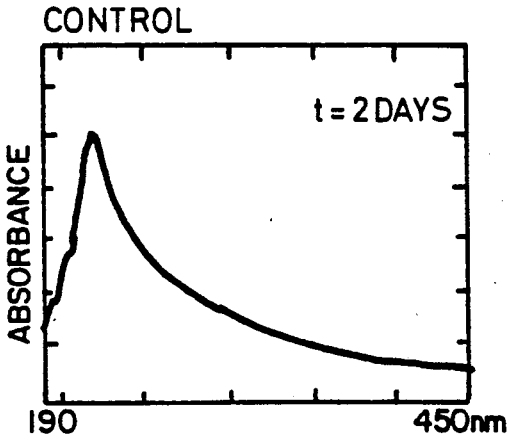
Figure 4Q:
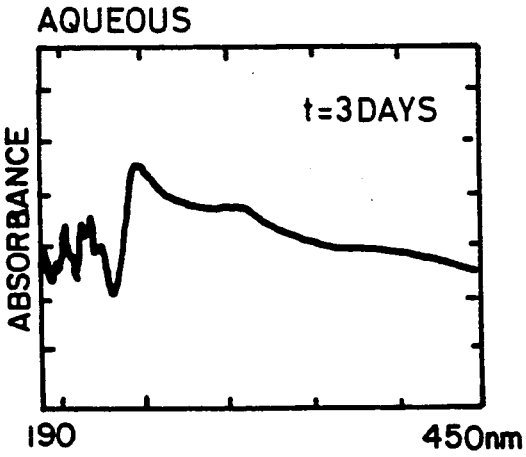
Figure 4R:
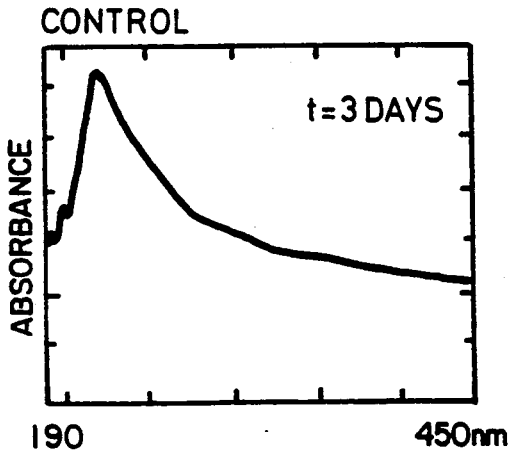
Figure 4S:
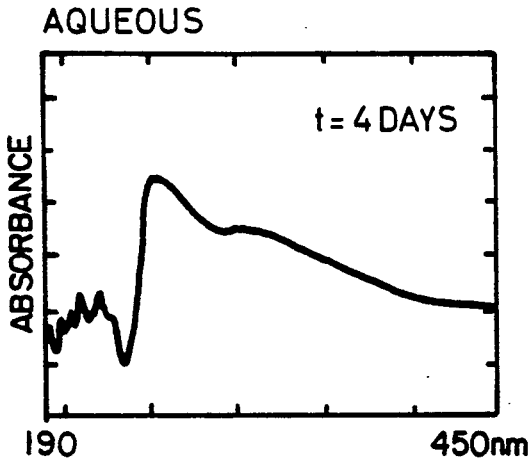
Figure 4T:
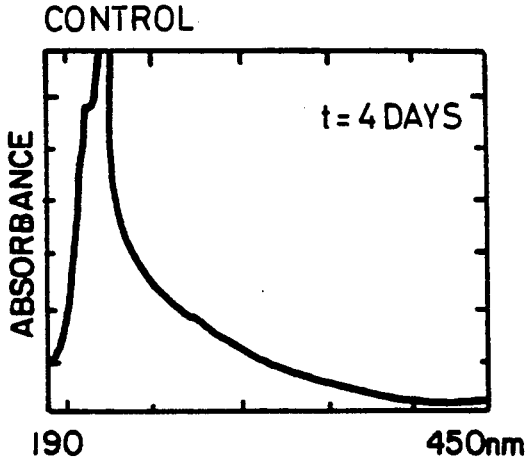
Figure 4U:
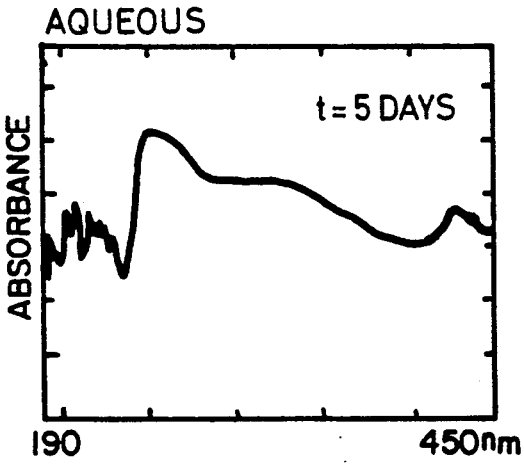
Figure 4V:
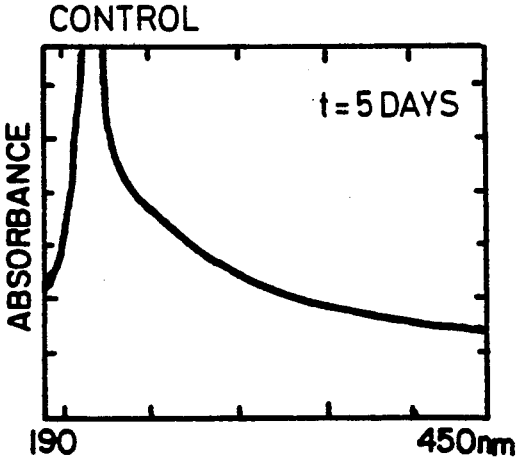
Figure 5A:
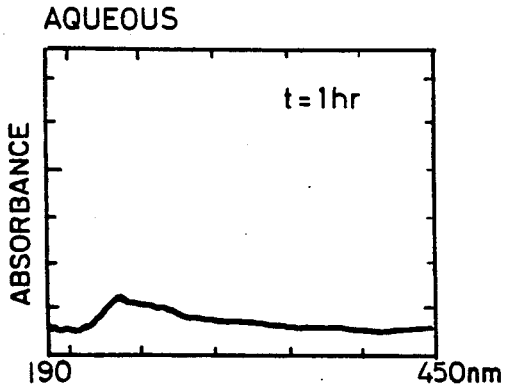
FIG. 5 is a graphical illustration of spectral data of filtrates of Illinois No. 6 coal at various periods of time following treatment with a peroxidase and a sulfatase as described in Example 3 hereinbelow. Each pair of figures shows data obtained from aqueous treated filtrates and that of the control for each time period as follows: A and B, 1 hour; C and D, 2 hours; E and F, 4 hours; G and H, 8 hours; I and J, 16 hours; and K and L, 24 hours.
Figure 5B:
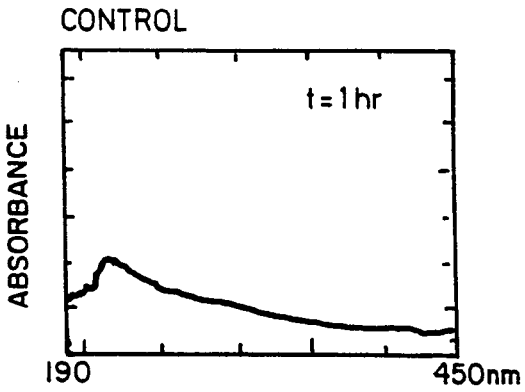
Figure 5C:
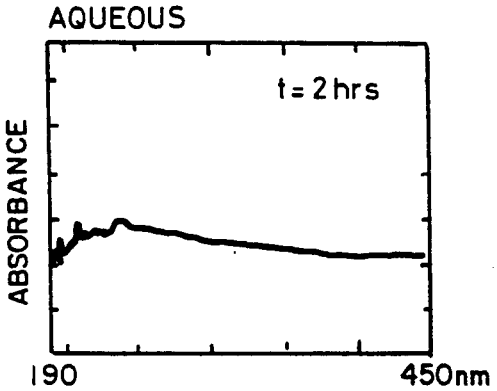
Figure 5D:
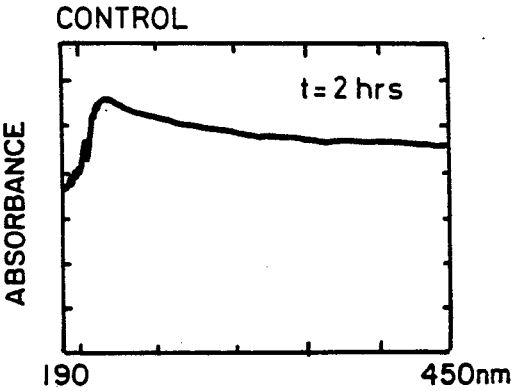
Figure 5E:
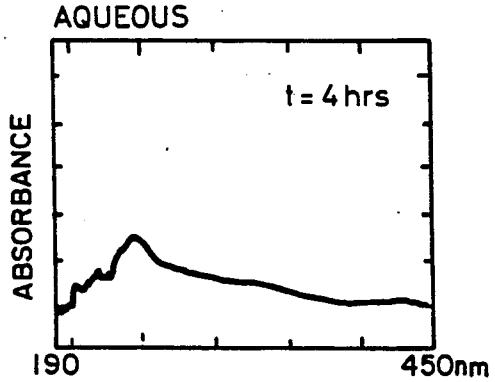
Figure 5F:
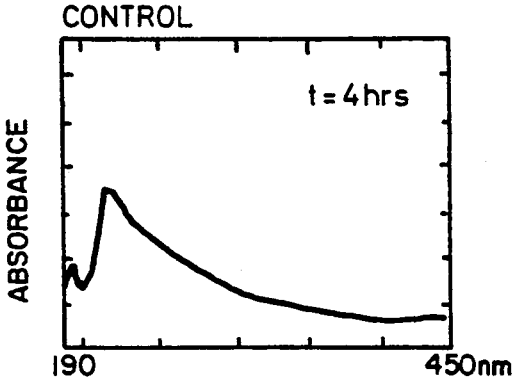
Figure 5G:
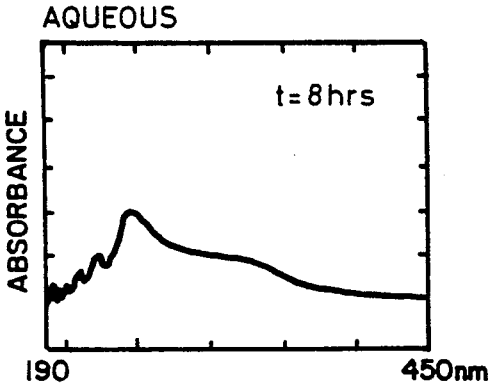
Figure 5H:
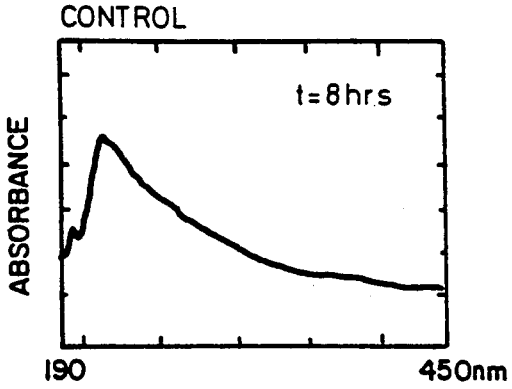
Figure 5I:
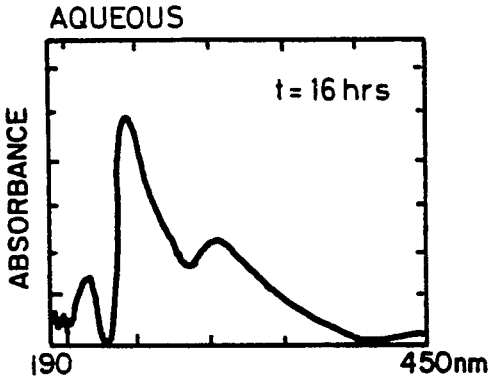
Figure 5J:
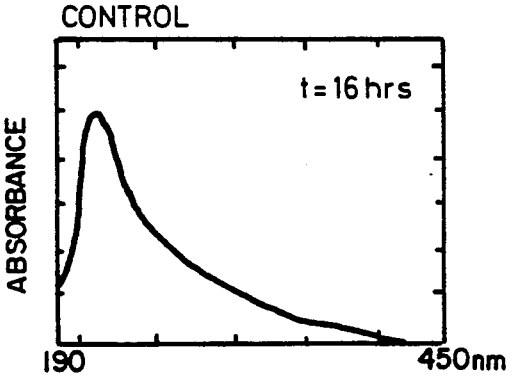
Figure 5K:
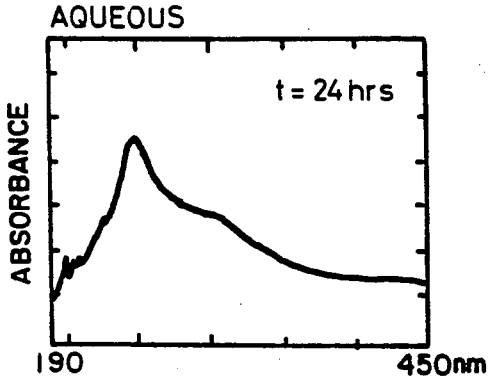
Figure 5L:
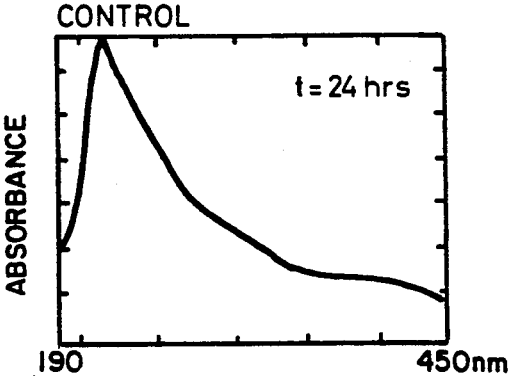

The coal particles may be treated with the oxidation and/or sulfatase enzymes, with or without additional chemical oxidation. One contemplated process scheme is a fluidized bed reactor as illustrated in FIG. 1. Generally, uniform concentration and temperature are maintained throughout the fluid bed reactor 100, and the enzyme is immobilized on support particles E which are relatively larger in size than the coal particles in the slurry typically fed into the lower portion of the reactor 100. This size difference permits retention of the enzyme support particles E by catalyst retention screen S and gravity separation in the upper portion of the reactor 100 near the effluent port C in the conventional manner of fluid bed operation. Air or other suitable gas is typically supplied to the bottom of the reactor 100 to promote back mixing and CSTR conditions.

An alternative processing scheme for a moving bed reactor, which generally follows the format of the Examples set forth below, is illustrated in FIG. 2. The coal slurry is introduced from hold-up/preparation tank 200 generally to the upper end of inclined moving bed 202 and discharged from the lower end thereof. As the coal descends through the reactor 202, it is continuously contacted with an enzyme solution containing oxidative enzymes and/or sulfatase enzymes, in a countercurrent fashion to release the organic sulfur as free sulfate which is soluble in the enzyme solution. The enzyme/-sulfate solution effluent from the reactor is recovered by adsorption on a sorbent in enzyme adsorption unit 204. The free sulfate solution is readily separated from the sorbent and collected in tank 206 in which, for example, lime or other basic material may be used to precipitate the sulfate prior to disposal. The adsorbed enzyme from unit 204 is then desorbed in unit 208. The desorbed enzyme is then recycled to the reactor 202 along with any makeup enzyme, while the sorbent may be recycled through the enzyme adsorption/desorption cycle.

The invention is illustrated by way of the examples which follow.

EXAMPLE 1

A suspension was prepared of 100 mg dibenzothiophene ("DBT") in 3 ml of 0.1M Tris buffer, pH 7.0. To this suspension at room temperature was added 0.5 ml of horseradish peroxidase (Sigma P 8000) at 2 mg/ml in buffer, and 0.5 ml of *Aerobacter aerogenes* sulfatase (Sigma S 1629) at 2 mg/ml in buffer. The mixture was maintained at room temperature in an air atmosphere, and reaction samples were periodically removed and filtered. Solids were analyzed for elemental composition and such analyses are presented in Table 1.

TABLE 1

| Sample | Elemental Analysis (weight percent) | | | | |
|---|---|---|---|---|---|
| | C | H | N | O | S |
| DBT | 78.26 | 4.35 | 0 | 0 | 17.39 |
| DBT/Peroxidase | 77.80 | 4.38 | 0.01 | 1.16 | 16.65 |
| DBT/Peroxidase/ Sulfatase | 76.62 | 4.12 | 0.19 | 3.88 | 15.19 |

Filtrates from the peroxidase/sulfatase treated DBT were analyzed for spectral changes and such spectral data are presented in FIG. 3. The spectral data demonstrate a spectral shift in the direction of longer wavelengths indicative of increased polarity which would be expected from conversion of DBT by the peroxidase/-sulfatase enzymes. The elemental analysis demonstrates an increase in oxygen content and a decrease in sulfur content. Moreover, it was also observed that starting reaction mixtures were distinctly two-phase liquid-solid mixtures whereas later reaction mixtures were strongly wetted and appeared as milky suspensions.

EXAMPLE 2

The procedure of Example 1 was repeated using 100 mg ball-milled Wyodak coal instead of DBT. The results are presented in Table 2 and FIG. 4.

TABLE 2

| Sample | Hours | Elemental Analysis (weight percent) | | | |
|---|---|---|---|---|---|
| | | C | H | N | S |
| Wyodak Coal | — | 65.96 | 4.57 | 0.95 | 1.70 |
| Wyodak Coal/ Peroxidase/Sulfatase | 1 | 59.47 | 4.99 | 0.98 | 0.90 |
| Wyodak Coal/ Peroxidase/Sulfatase | 2 | 60.42 | 5.12 | 1.15 | 0.79 |
| Wyodak Coal/ Peroxidase/Sulfatase | 4 | 58.84 | 5.04 | 1.08 | 0.95 |
| Wyodak Coal/ Peroxidase/Sulfatase | 24 | 60.35 | 5.30 | 1.22 | 0.30 |

The spectral changes demonstrated in FIG. 4 for Wyodak coal are similar to, although more pronounced than those observed with DBT, indicating more extensive reacting of the Wyodak coal than the DBT, in the presence of the peroxidase and sulfatase.

The large drop in sulfur percentage by elemental analysis seen in the data in Table 2 indicates that about 80% of the total sulfur was removed from the coal. It is believed that the results with the Wyodak coal are better than with DBT because only a fraction of the organic sulfur in coal is aromatic, thiophene-type sulfur which is generally more recalcitrant to chemical conversion than other types of organic sulfur found in coal. The increase in nitrogen percentage is probably due to adherence of the enzymes to the coal particles.

EXAMPLE 3

The procedure of Example 2 was repeated using Illinois No. 6 coal instead of Wyodak coal. The results are presented in Table 3 and FIG. 5.

TABLE 3

| Sample | Hours | Elemental Analysis (weight percent) C | H | N | S |
|---|---|---|---|---|---|
| Illinois No. 6 Coal | 0 | 70.39 | 4.48 | 1.44 | 3.60 |
| Illinois No. 6 Coal/ Peroxidase/Sulfatase | 1 | 58.72 | 5.01 | 0.94 | 0.91 |
| Illinois No. 6 Coal/ Peroxidase/Sulfatase | 2 | 58.56 | 5.00 | 1.14 | 0.98 |
| Illinois No. 6 Coal/ Peroxidase/Sulfatase | 4 | 58.36 | 5.07 | 1.22 | 1.72 |
| Illinois No. 6 Coal/ Peroxidase/Sulfatase | 24 | 58.27 | 5.14 | 1.21 | 0.84 |

As seen from Table 3 and FIG. 5, the enzyme-mediated treatment of Illinois No. 6 coal desulfurizes the coal in a manner similar to the Wyodak coal.

The foregoing disclosure and description of the invention are illustrative and explanatory thereof, and various changes in the size, shape and materials, as well as in the details of the illustrated construction may be made without departing from the spirit of the invention.

We claim:

1. A method for reducing the total sulfur content of a fossil fuel containing organic sulfur comprising the steps of:

contacting the fossil fuel with a solution containing sulfatase to release organic sulfur as water-soluble free sulfate;

recovering from the solution a fossil fuel having a reduced sulfur content.

2. The method of claim 1, wherein the fossil fuel is coal, petroleum, or a process-derived product thereof.

3. The method of claim 1, wherein the organic sulfur a thiophene, sulfide, thiol or a combination thereof.

4. The method of claim 1, further comprising the step of:

contacting said fossil fuel with an oxidizing agent.

5. The method of claim 4, wherein said oxidizing agent is an alkali.

6. The method of claim 4, wherein said oxidizing agent is an acid.

7. The method of claim 4, wherein said oxidizing agent is an oxidation enzyme.

8. The method of claim 4, wherein the contact with said oxidizing agent and said sulfatase enzyme is consecutive.

9. The method of claim 4, wherein the contact with said oxidizing agent and said sulfatase enzyme is concurrent.

10. The method of claim 7, wherein said oxidation enzyme and said sulfatase are immobilized on packing during said step of contacting with said oxidation enzyme and said sulfatase.

11. The method of claim 7, wherein said oxidation enzyme is peroxidase or laccase.

12. The method of claim 7, wherein said oxidation enzyme is horseradish peroxidase.

13. The method of claim 12, wherein said contacting with said peroxidose is in the presence of excess oxygen, at a temperature from 0° to 80° C. and a pH of from 5 to 9, and with an amount of the peroxidase ranging from about 0.01 to 10 parts by weight per 100 parts by weight of the fossil fuel.

14. The method of claim 1, wherein said sulfatase is selected from the group consisting of Aerobacter species sulfatase, limpet sulfatase, abalone entrail sulfatase, and Helix species sulfatase.

15. The method of claim 14, wherein said sulfatase is *Aerobacter aerogenes* arylsulfatase.

16. The method of claim 15, wherein said contacting with said sulfatase is in the presence of excess water at a temperature from 0° to 80° C. and a pH of from 5 to 9, and with an amount of the arylsulfatase ranging from about 0.01 to about 10 parts by weight per 100 parts by weight of fossil fuel.

17. The method of claim 16, wherein said contacting with said sulfatase is in the presence of from about 0.1 to about one parts by weight of water per 100 parts of weight of the fossil fuel.

18. The method of claim 1, further comprising the step of:

recovering from the solution a soluble sulfate by filtration, centrifugation or ion exchange adsorption.

* * * * *